United States Patent [19]

Lang, Jr.

[11] 4,029,321

[45] June 14, 1977

[54] CARD AND BOARD MAP GAME

[76] Inventor: Charles G. Lang, Jr., Mato Maranhao 98, Capelas, Sao Miguel, Azores, Portugal

[22] Filed: Apr. 26, 1976

[21] Appl. No.: 679,901

[52] U.S. Cl. ..... 273/135 AB; 273/135 AC; 273/136 C; 273/152.41; 273/152.6

[51] Int. Cl.[2] ..... A63F 3/04

[58] Field of Search ..... 273/135 AB, 135 AC, 273/134 AC, 131 BB, 130 G, 134 C, 152.6, 135 R, 152.41

[56] References Cited

UNITED STATES PATENTS

| | | | |
|---|---|---|---|
| 454,861 | 6/1891 | Gaddis et al. | 273/152.6 |
| 753,949 | 3/1904 | Wing | 273/135 AB |
| 940,855 | 11/1909 | Clemens | 273/134 AC |
| 1,550,190 | 8/1925 | Warner | 273/134 AC |
| 2,177,790 | 10/1939 | Scott | 273/135 AB |
| 2,399,902 | 5/1946 | Wood | 273/134 AC |
| 3,064,979 | 11/1962 | Ralston | 273/135 AB |
| 3,674,274 | 7/1972 | Schur | 273/135 AC |
| 3,947,038 | 3/1976 | Archer | 273/134 AC |

*Primary Examiner*—Anton O. Oechsle
*Assistant Examiner*—Harry G. Strappello
*Attorney, Agent, or Firm*—Nicholas A. Gallo, III

[57] ABSTRACT

The game utilizes a board containing a map of the world divided radially into a series of zones. The cards used each contain the name of a nation and the flag of a different nation. Each player is assigned zones of play, and during his turn places face up and plays any card in his hand as to which he can identify on the map a country in his zone of play which corresponds to the name of a nation or flag of nation on the card. A pin is placed on the board and the portion of the card played covered to indicate that the play has been made. Each player can play the other portion of a card already played if the nation represented is in his zone of play. The card deck also contains cards which, when played, change the assigned zones of play.

3 Claims, 13 Drawing Figures

Fig.8.
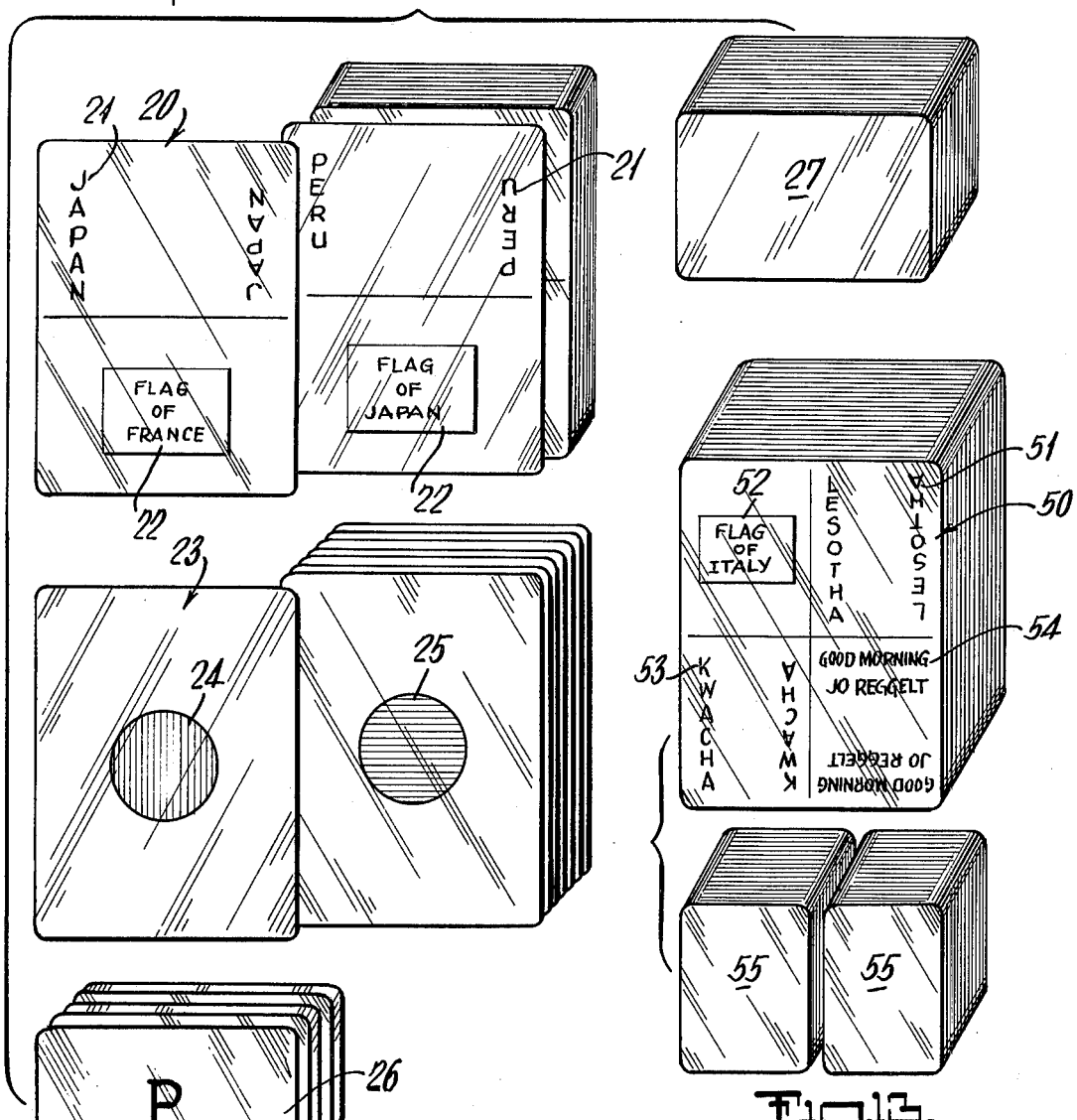
Fig.13.
Fig.9.
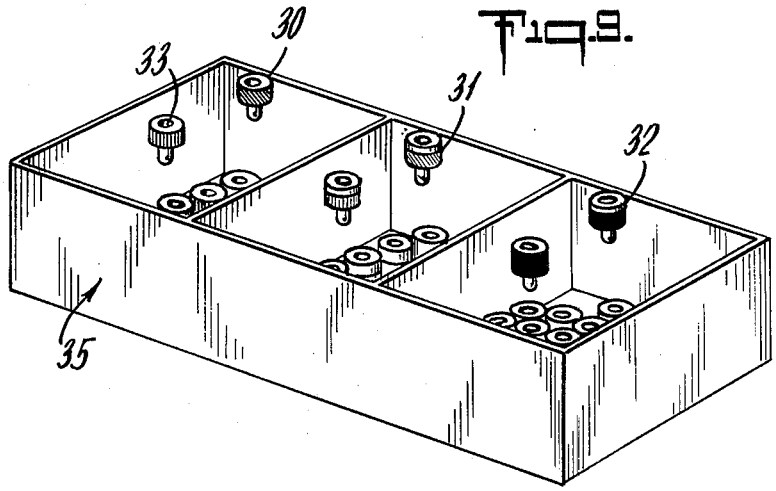

CARD AND BOARD MAP GAME

BACKGROUND

This invention relates to a game and, more particularly, to a skill and chance controlled card and board map game.

Over the years, map games, that is, games in which the players identify geographical subdivisions from information cards or the like concerning them, have been popular with young children. In these games, the players usually identify the geographical subdivisions by placing a marker on the subdivision on a board. Each play is discrete and final. Of course, as the players become proficient, interest is lost in the game, and such interest cannot be regained for long even by the introduction into the game of simple elements of chance such as randomly distributing or "dealing" the information cards.

For these reasons, and because older children and adults are too proficient in such subjects to be even initially interested, these games are usually relegated to the very young and the market for them is limited.

SUMMARY

The current invention is designed to additionally appeal to adults and older children and to hold such appeal over an extended period of time. This is accomplished by incorporating into the game (a) secondary and tertiary elements of chance, (b) the ability of the players to interfere with or affect the play of one or more of the other players, and (c) plays which are other than discrete closed plays.

In the subject game, a portion of a deck of cards, in which each card carries indicia associated with geographical subdivisions on the board ("Information Cards"), is dealt to the players and the remainder of the pack set aside as stock for later use in a pattern of drawing and discarding. This deal is the primary element of chance typical of such games. However, a secondary element of chance is added by distributing to each player a card which limits the play of the player to a particular identified series of zones defined on the map ("Zone Card") thus, at least temporarily, making certain of the cards in the player's hand useless. A tertiary element of chance is introduced by including in the deck cards, which when played change the assigned zones of play for one or more players ("Zone Change Cards").

The major skill factor is, of course, proper identification of the geographical subdivisions. A secondary skill factor, recognition of one's own strengths and the other player's weaknesses in a given series of zones is introduced into the game by permitting a player to change the zones of play of one or more players by discarding a Zone Change Card under certain conditions.

Finally, in the subject game, the information cards are unique. Each such card carries on one side thereof a plurality of sets of indicia, each set representing a different subdivision. As each play is made and markers placed on the board, the card is placed face up and another player may make a play on one of the remaining sets of indicia if it corresponds with a subdivision in his zones of play. Thus, play tends to be somewhat open ended.

DRAWINGS

The details of the game in its preferred embodiment will be understood by reference to the drawings and the complete description which follows:

Figure 1:
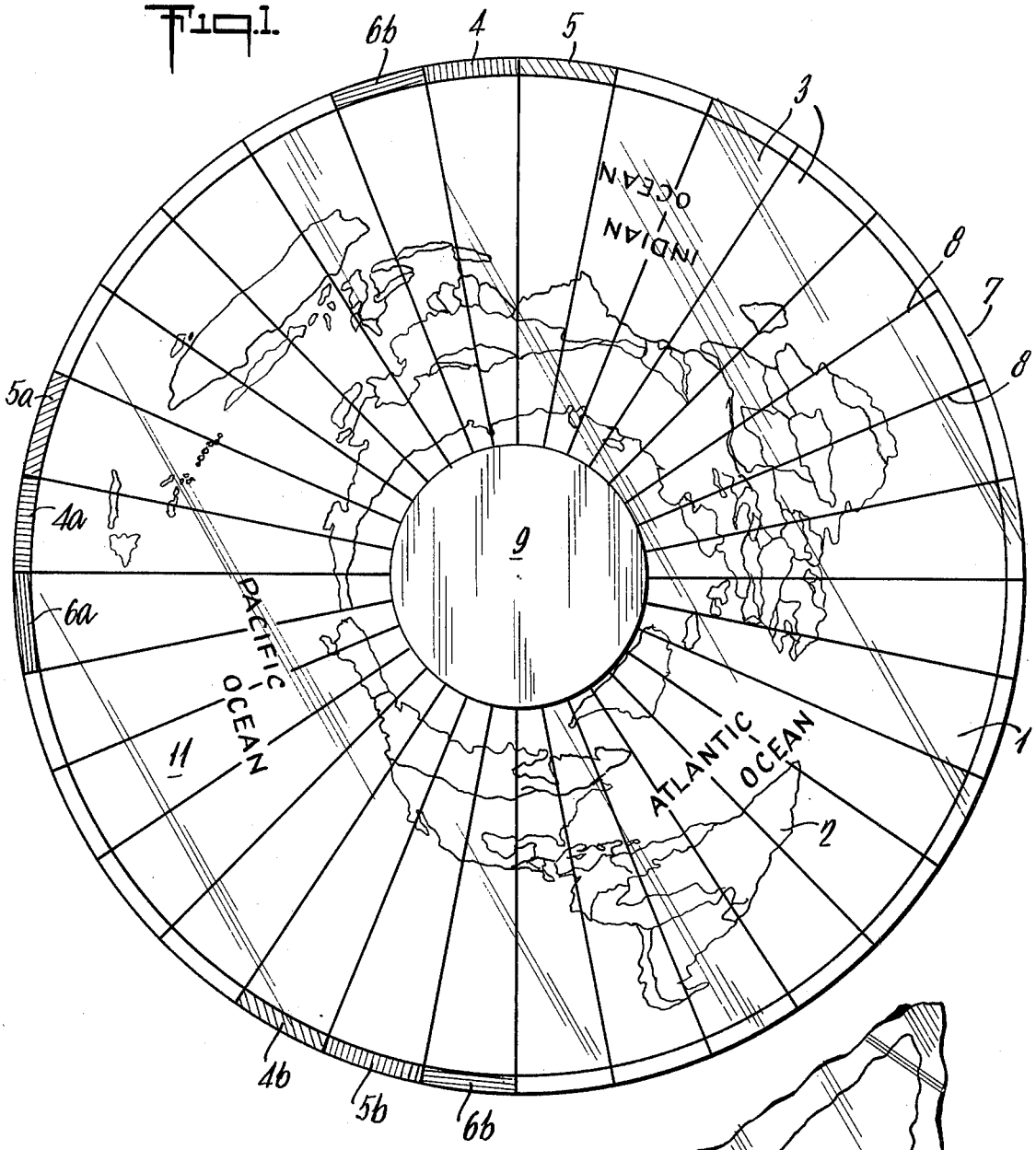
FIG. 1 illustrates a game board of the type used in this game.
Figure 2:
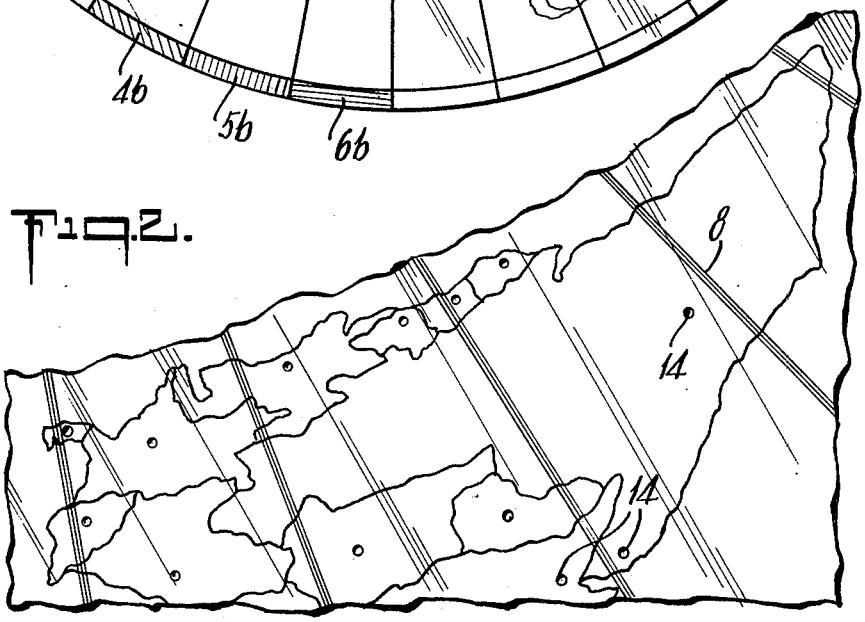
FIG. 2 is a closeup of a portion of the board of FIG. 1 showing holes in the board designed to receive markers of play.
Figures 3, 4, 5, 6, 7:
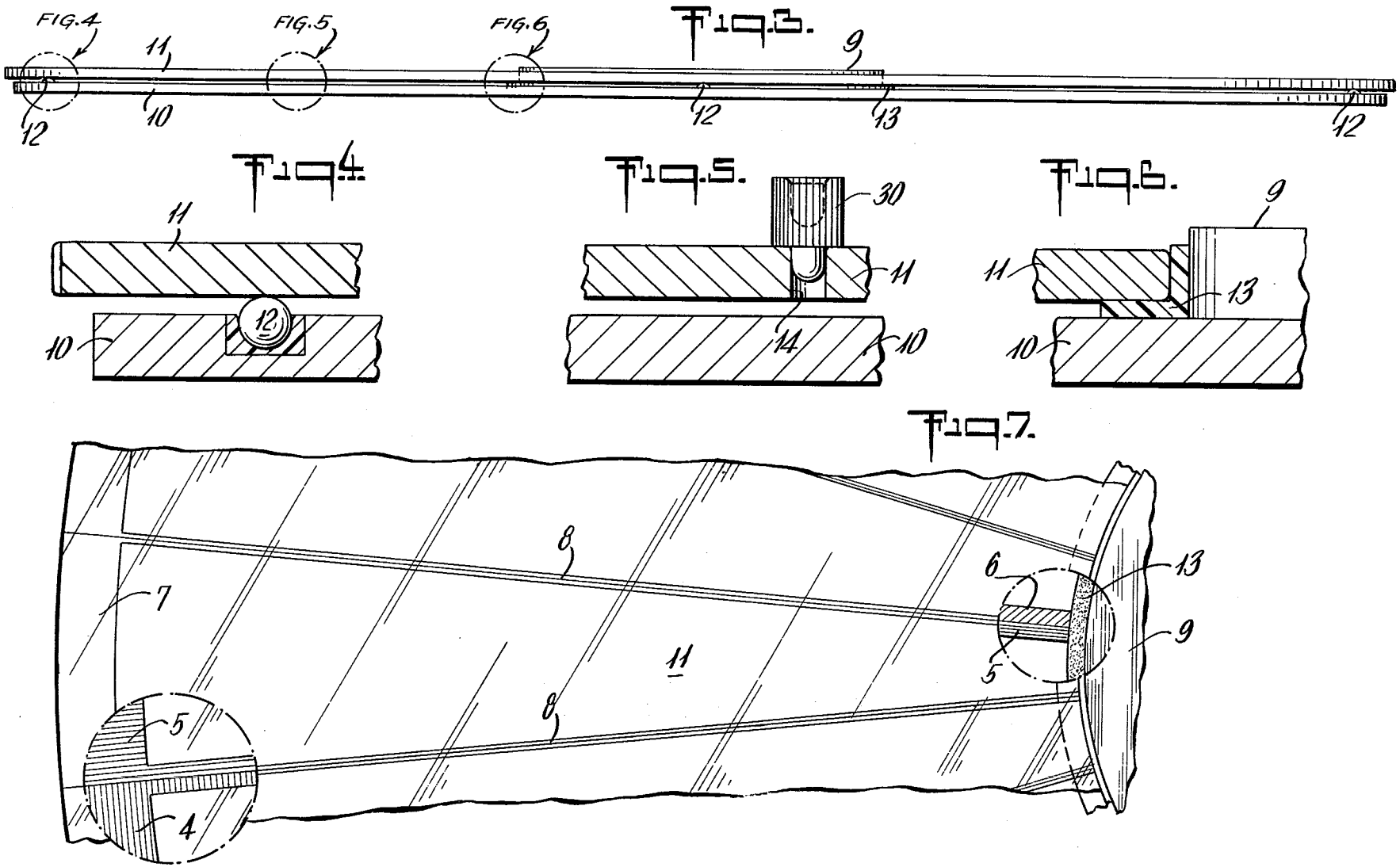
FIG. 3 is a cross section of the board of FIG. 1.
Figure 10:
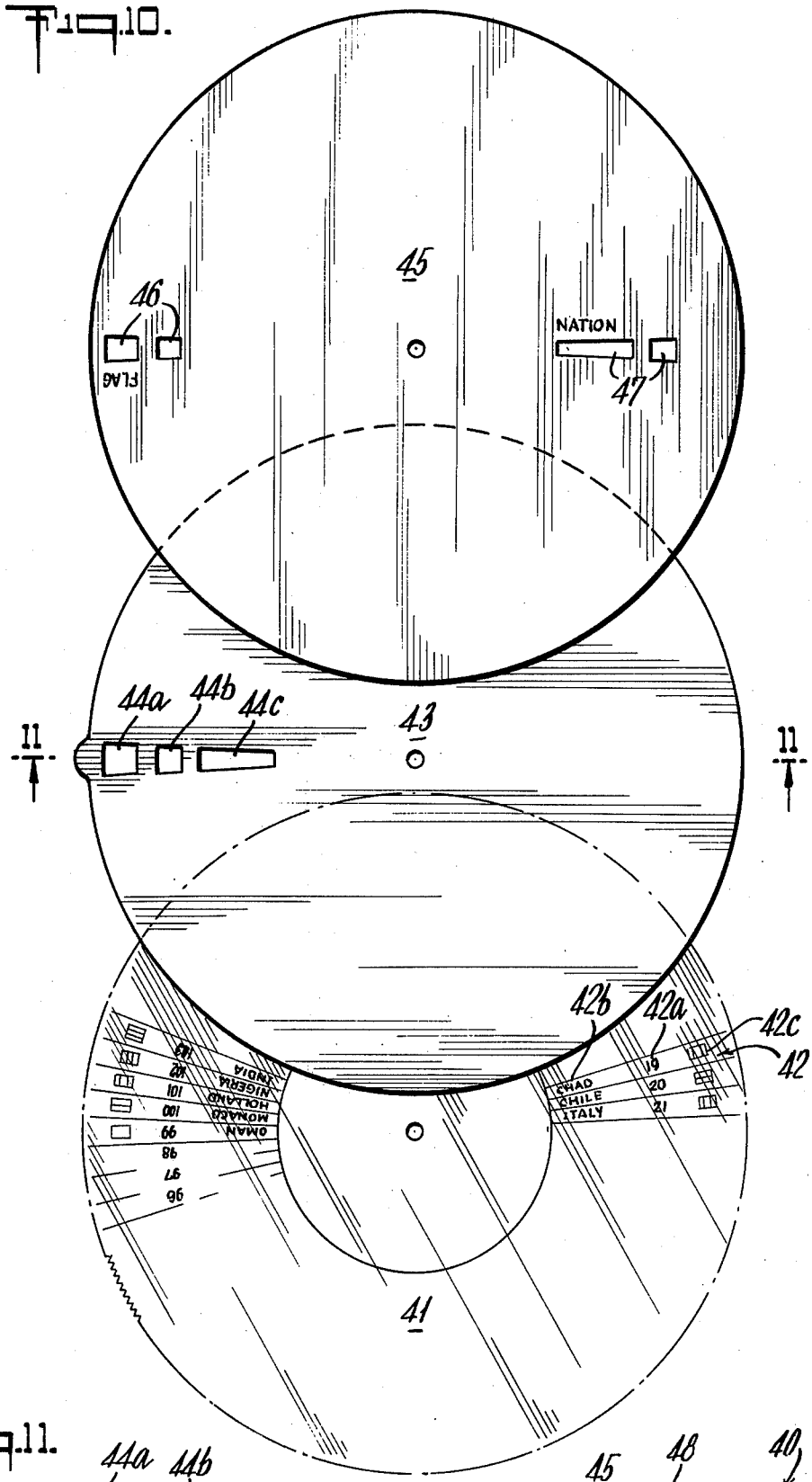
Figure 11:
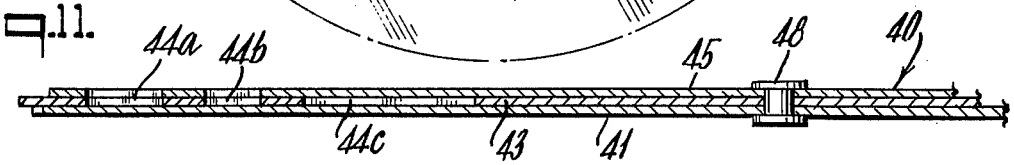
Figure 12:
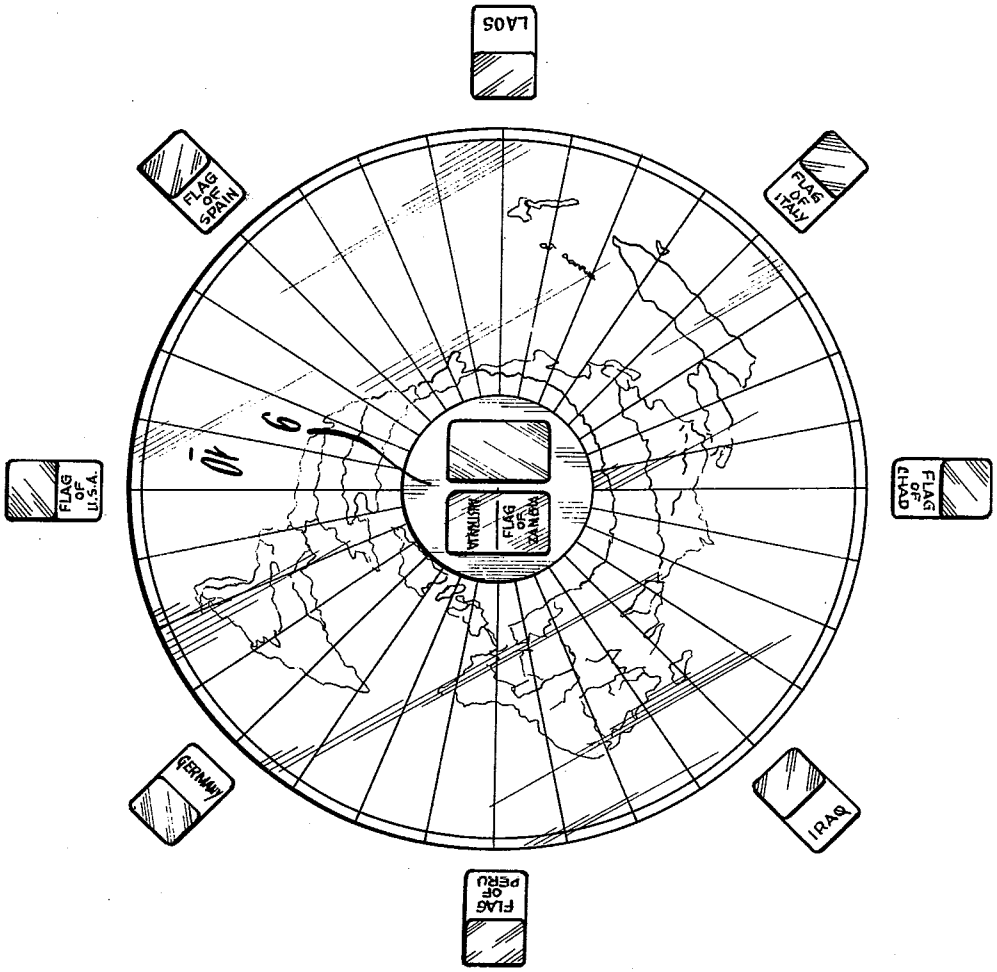

FIGS. 4, 5, and 6 are enlarged views in cross sections showing detail of the board taken at the points indicated in FIG. 3;

FIG. 7 is an enlarged view portion of the board of FIG. 1 showing the detail of certain indicia on the board;

FIG. 8 illustrates the cards used in one version of the game;

FIG. 9 illustrates markers used with the game and a container for such markers;

FIG. 10 illustrates in exploded view an index used in conjunction with the game;

FIG. 11 is a cross section of such index taken along lines 11 — 11 of FIG. 10;

FIG. 12 is a view of the game in progress;

FIG. 13 illustrates cards used in another version of the game.

DETAILED DESCRIPTION

The game board, 1, of FIG. 1 contains indicia, 2, representing a map defining a large number of political subdivisions, in this instance the countries of the world.

The map is divided into a multiplicity of zones, 3. There is associated with each zone, 3, indicia, 4,5 and 6, which correlate each zone with a plurality of nonadjacent zones, **4*a* and 4*b*, 5*a* and 5*b*, and 6*a* and 6*b*,** so as to provide to each player a plurality of recognizable assigned zones for play.

The board is preferably round to facilitate play by a large number of players and, in such instance, the zones are conveniently set out radially as shown. In such instance, it is also convenient to use, as illustrated, color coding along the edges, 7, and sides, 8, of the zones to define and coordinate the zones but other means of identification and coordination can be used.

When the map and board is round as shown, it is advantageous to make the board in the form of a reverse "lazy susan." In other words, the board has a stationary center, 9, which is part of a base, 10, with a main playing surface, 11, rotatably mounted about the center. This can be accomplished in a number of ways. In the version illustrated (See FIGS. 4 and 6) the main playing surface, 11, is supported at its periphery by a series of rotatable balls, 12, mounted in the base, 10, and supported at the center by a height equalizing member, 12, on which it can slide.

The playing surface can be divided into almost any number of zones. However, the number of zones should be divisible by an even number since even numbers of people usually play such games. In addition, each player should have assigned to him at least four zones of play. Since at least four persons usually play such a game, at least 16 zones are preferred. In the version illustrated, the board is divided into 32 zones grouped into series of four zones each.

Referring now to FIG. 8, the Information Cards, 20, each contain at least two sets of indicia, 21 and 22, each set associated with a different geographical subdivision on the map. Each subdivision is represented on a number of cards equal to the number of sets of indicia which appear on each card. It is desirable that the various subdivisions associated with the various sets of indicia on a given card lie within different sets of zones. In the version shown, the name of countries and their flags are used as the two sets of indicia, but others are possible. Other possibilities are currencies, words in the official language, capital cities, politicians, figures of ancient history, etc. It is preferable that the indicia used be exclusively associated with a particular subdivision. Whatever these indicia are they, of course, must not appear on the map itself.

The Zone Cards, 23, contain indicia, 24 and 25, which correlate with the indicia, 4 and 5, which identify the zones of play. These cards can also be used as the Zone Change Cards by using them separately first to initially assign the zones and then including them in the deck for actual play. In the version illustrated, these cards merely carry an identifying spot of color.

Since in the version illustrated countries are the political subdivision, the deck as of this date contains 157 Information Cards. When using this number of Information Cards and when using a board having 32 zones coordinated into eight series of four zones each, it is desirable to provide the deck with a number of Zone Change Cards equal to the number of series of zones on the board.

Further excitement can be introduced into the game by including a limited number of "Wild Cards," 26. These provide a player possessing the same an additional but defined degree of freedom. In the version illustrated, these cards permit the player to "Pick" a zone for subsequent play.

Making reference to FIG. 9, markers, 30, 31, and 32, are provided to differentiate and record the plays. Because of the large number of plays which may occur in the version of the games illustrated, the markers are in the form of pins which are inserted into holes, 14, provided in the board. Since any given subdivision is represented on at least two information cards, the board would become crowded if the pins were not provided with a recess, 33, for receiving another pin. When, as illustrated, the different indicia used on the information cards represent different degrees of difficulty, the markers are coded so as to indicate this for scoring purposes. In the version shown, the marker box, 35, contains scoring pegs, 30, for indicating one point for each country name correctly associated with a point on the map, scoring pegs, 31, for indicating two points for each flag associated with a point on the map, and pegs, 32, indicating a penalty for incorrect play and used as described later.

Referring to FIGS. 10 and 11, a convenient index, 40, consists of a circular base element, 41, containing a series of sets of radially disposed indicia, 42, associating each numbered position, 42*a*, on the board with the name, 42*b*, of the corresponding country and the flag, 42*c*, of that country. Overlying the base element is a circular intermediate element, 43, having windows, 44*a*, *b* and *c*, therein which expose one set of indicia at a time. Overlying the intermediate member is a cover member, 45, having two sets of windows, one set, 46, located radially so as to expose the number and associated flag of country, and the other set, 47, located radially so as to expose the number and associated name of country. The three elements are rotably mounted with respect to each other by virtue of a pin, 48.

The game can be played a number of ways. In the usual method of playing the game, play is begun by fanning out the card deck face down on the table and each player selecting a card. The player who picks the card that has the name of a nation on it beginning with the lowest letter in the alphabet is the dealer. The dealer then places Zone Cards face down on the table and each player selects a card. This is the method used to decide which zones of map each player starts with and is the secondary element of chance referred to earlier. In the version illustrated, if a player picks a card with a red circle on it, he begins game using the four zones of map that are colored red on the outer rim as his playing areas. The player who picks card with green circle uses the green zones.

In the version of the game illustrated, the dealer puts the Zone Cards back in the desk so they now can act as the Zone Change Cards, shuffles the cards, and after the cut, deals 10 cards to each player, then places the stack of undealt cards on stationary center of board and turns a card face up beside the pack. The dealer then counts out an equal number of each type of scoring peg to each player.

The game is most interesting when the players are given a large number of decisions to make. Thus, each player during his turn should have the option at any time to draw and play a card from the top of the stock or the top face-up card beside the stock. He can, of course, never hold more or less than 10 cards in his hand and must draw and discard to maintain this number.

The player to left of dealer usually goes first. Assuming he decides not to draw a card, he will likely play the card of which he is most certain that he can associate either the name of nation of flag-of-nation with the nation outline on map. He places this card face-up on the table in front of him and puts an appropriate one of his scoring pegs in the hole of what he thinks is the nation.

After the play is made, the dealer, using the index, determines if the play was correct and if it was correct, the indicia played are obscured in some way so it is known that they are no longer available for play. For this purpose, a stack of plain cards, 27, as shown in FIG. 8, is conveniently provided with the game. If the play is incorrect, the player puts the card back in his hand, takes the peg out of the map and takes a penalty peg out of peg box and adds it to his supply of pegs. The player's turn continues until he makes an incorrect play.

After a round of such play, the cards played will generally take on an appearance such as illustrated in FIG. 12.

As noted earlier, the Zone Change Cards present in the deck during play can be used to introduce an additional element of chance and skill. Any time a Zone Change Card is face-up on the discard pile, the player who next must make a play vacates his assigned series of zones and assumes the indicated series of zones and the player who was previously assigned that series of zones assumes the vacated series of zones. This means that the initial turnover by the dealer can by chance cause this to happen. A discard at the end of a turn can cause this to happen. A discard during a turn can intentionally cause this to happen without ending the turn. The wild Pick cards included in the deck are used in a similar manner except, of course, they are cards of permission rather than cards of coercion and offer a choice of any series of zones on the board.

As noted earlier, a somewhat open-ended play is maintained in this game. Referring again to FIG. 12, this is accomplished through the unused and uncovered portions of the previously played cards. Each player during his turn can, in addition to making a play on the cards in his hand, make a play on any card on the table if it relates to his zones of play.

In scoring the game, the object is to end up with as few pegs worth as few points as possible. The number of points assigned to each type of play can be varied to suit the desires of the participants. Each round, that is, each series of plays following a deal, conveniently ends when the last card of the stack is used, although it may be continued until one player is able to play all the remaining cards in his hand. The game usually continues until each player has served as dealer for one hand.

The excitement of the game can be further increased by permitting any player to challenge the play that has been made. This challenge can take the form of requiring the challenger to simply indicate that the play was incorrect or also requiring the challenger to make the correct play. If the challenger is required to make the correct play, he can be required to either identify on the map the correct location of the nation corresponding to the name of nation or flag of nation on the card played or to identify the name of the nation or flag of the nation corresponding to the incorrect map location on which the marker was placed. When this latter type of challenge is used, it is necessary to provide a pictorial listing in random order of the flags of nations. The challenger points to the correct flag and the dealer then checks the index to see if the choice was correct. The pictorial listing of flags is conveniently arranged on the box or around the outer edges of the board. The same system of scoring, including penalties, applicable to the basic plays is generally also used for the challenges.

FIG. 13 illustrates another type of Information Card, 50, used with the game. It contains not only names of countries, 51, and flags of countries 52, but also the monetary units, 53, and a set of indicia, 54, consisting of an English word with the corresponding word in the official language of a country. The use of these cards permit four plays to be made on each card. Stacks of plain cards, 55, of a size needed to cover one-quarter of the Information Card as it is played in a fashion analogous to cards, 27, of FIG. 8 are conveniently provided with the game.

What is claimed is:

1. A skill and chance influenced game comprising:

a game board containing indicia representing a map defining a large number of different political subdivisions and divided into a multiplicity of zones, there being associated with such zones indicia which correlate each zone only with a plurality of nonajacent other zones so as to provide to each player a plurality of recognizable assigned zones for his play;

a card deck containing cards divided into a plurality of sections, one section containing a type of indicia associated with a first political subdivision shown on the board and a second section containing a second type of indicia associated with a second political subdivision differing from the first shown on the board;

whereby in playing said game, a player attempts to correctly identify the position on the map of the political subdivision in his zone of play associated with any indicia on cards assigned to him and after which any second player can attempt to correctly identify the position on the map of the political subdivision in the second player's zone of play represented by the second indicia on the card.

2. A skill and chance influenced game comprising:

a game board containing indicia representing a map defining a large number of different political subdivisions and divided into a multiplicity of zones, there being associated with such zones indicia which correlate each zone only with a plurality of nonadjacent other zones so as to provide to each player a plurality of recognizable assigned zones for his play;

a card deck containing cards divided into a plurality of sections, one section containing a type of indicia associated with a first political subdivision shown on the board and a second section containing a second type of indicia associated with a second political subdivision differing from the first shown on the board, said deck of cards also containing a second type of card having indicia corresponding to the indicia coordinating the zones of the board;

whereby in playing said game, a player attempts to correctly identify the position on the map of the political subdivision in his zone of play associated with any indicia on cards assigned to him and after which any second player can attempt to correctly identify the position on the map of the political subdivision in the second player's zone of play represented by the second indicia on the card; and whereby any player having access to a card of the second type of card can through its use interchange the zone assigned to him with the zone assigned to another player.

3. A skill and chance influenced game comprising:

a game board containing indicia representing a map definig a large number of different political subdivisions and divided into a multiplicity of zones, there being associated with such zones indicia which correlate each zone only with a plurality of nonadjacent other zones so as to provide to each player a plurality of recognizable assigned zones for his play;

a card deck containing cards divided into a plurality of sections, one section containing a type of indicia associated with a first political subdivision shown on the board and a second section containing a second type of indicia associated with a second political subdivision differing from the first shown on the board, said deck of cards also containing a second type of card having indicia corresponding to the indicia coordinating the zones of the board;

markers of a plurality of types, the number of types at least being as great as the number of different sections of said cards and coded to correlate thereto so as to be used to indicate each play successfully completed and, by reference to their type, to calculate the score; and an index for consultation for determining correct and incorrect plays;

whereby in playing said game, a player attempts to correctly identify the position on the map, by placement of the markers, of the political subdivision in his zone of play associated with any indicia on cards assigned to him and after which any second player can attempt to correctly identify the position on the map by placement of the markers of the political subdivision in the second player's zone of play represented by the second indicia on the card; and whereby any player having access to a card of the second type of card can through its use interchange the zone assigned to him with the zone assigned to another player.

* * * * *